United States Patent [19]

Miller et al.

[11] 3,964,235

[45] June 22, 1976

[54] ROLL-UP COMPRESSIVE PACKAGING APPARATUS

[75] Inventors: Ward B. Miller, Waterville; Daniel A. McCartan, Heath, both of Ohio

[73] Assignee: Owens-Corning Fiberglas Corporation, Toledo, Ohio

[22] Filed: Aug. 26, 1974

[21] Appl. No.: 500,795

Related U.S. Application Data

[63] Continuation-in-part of Ser. No. 412,236, Nov. 2, 1973, Pat. No. 3,911,641.

[52] U.S. Cl. ..... 53/118; 53/124 C; 226/95; 226/110

[51] Int. Cl.[2] ..... B65B 63/04; B65B 27/12

[58] Field of Search ..... 53/24, 124 D, 124 C, 53/214, 215, 118, 137, 199, 21 FW, 389, 139.3; 242/DIG. 3; 100/87, 5; 198/76, 184, 27; 226/110, 95; 83/650

[56] References Cited

UNITED STATES PATENTS

| | | | |
|---|---|---|---|
| 1,006,009 | 10/1911 | Sargent | 53/118 |
| 1,486,360 | 3/1924 | Brown | 100/87 |
| 2,362,677 | 11/1944 | Stephens | 198/76 |
| 2,635,401 | 4/1953 | Cook et al. | 53/215 X |
| 2,776,094 | 1/1957 | Edwards et al. | 53/137 X |
| 2,973,607 | 3/1961 | Mosier | 53/389 X |
| 3,133,386 | 5/1964 | Johnston | 53/118 X |
| 3,196,591 | 7/1965 | Guido et al. | 53/137 |
| 3,540,187 | 11/1970 | Monaghan | 53/389 X |
| 3,716,964 | 2/1973 | Reynolds et al. | 53/389 |

*Primary Examiner*—Travis S. McGehee
*Assistant Examiner*—Horace M. Culver
*Attorney, Agent, or Firm*—John W. Overman; Allen D. Gutchess, Jr.; Charles F. Schroeder

[57] ABSTRACT

Apparatus is provided for packaging compressible material in strip from, such as building insulation. The compressible strip is wound into a roll and held under compression during rolling to provide a compact package. The compressed package can then be held by two tapes, without additional overwrap, which tapes are automatically fed onto an end portion of the compressible strip as it is being rolled up, with the package then being automatically ejected. The apparatus includes an endless belt carried on a frame and positioned and driven in a manner to form a loop in itself which is in the path of the compressible strip being lineally moved toward the belt. The belt is driven to roll the strip as it is moved into the loop and means are provided for maintaining the belt under tension to place the strip in compression. The tension means for the belt also can increase pressure on the strip during rolling, and as the loop and roll enlarge, although the tension means can be arranged to reduce the pressure, if desired. The tape is fed from underneath to a trailing end portion of the strip and is wrapped around the roll after entering the loop. When the roll is completed, part of the frame for the belt is moved away from a stationary part to open the loop and automatically eject the compressed, packaged roll. The apparatus includes a multi-zone, suction conveyor to aid in feeding the compressible strip into the loop. The apparatus also includes facilities for relatively easily removing and replacing the endless belt, when needed.

16 Claims, 14 Drawing Figures

ROLL-UP COMPRESSIVE PACKAGING APPARATUS

This application is a continuation-in-part of our copending application Ser. No. 412,236, filed Nov. 2, 1973 and now U.S. Pat. No. 3,911,641.

This invention relates to apparatus for packaging a strip of compressible material into a compressed roll held by tapes or the like extending therearound.

Heretofore, strips of compressible material, and specifically building insulation, have been removed from the end of the line on which they are formed and packaged by workmen who individually handle the rolls. The packaging heretofore has been slow and laborious with the rolls requiring considerable handling. Further, the packaged strips have not always been as neat or compressed to the extent desired. Limited attempts to partially automate the packaging of the insulation have not been successful.

The present invention provides apparatus for packaging building insulation and the like in which a compressible strip of insulation is received directly into the apparatus from the end of a production line on which it is made. The strip is rolled on itself under compression and taped automatically to provide a finished, packaged roll which is then automatically ejected from the apparatus. The insulation is not handled at all until it is in the complete, packaged form. The insulation is compressed in the package to an extent exceeding that heretofore achieved, and the insulation is also rolled more uniformly into the roll, with lesser tendency to project or telescope to one side. Further, the labor or effort required by the workmen is less than heretofore needed in packaging such material.

More specifically, the apparatus according to the invention includes an inclined suction conveyor aligned with the discharge end of a conveyor of the production line on which the strips of building insulation are made. Typically, two or three strips of the building insulation are formed in side-by-side relationship and are discharged longitudinally off the end of the conveyor, these also being simultaneously rolled up and packaged. Each of the strips comprises a layer of compressible fibers held together by a binder and in many instances adhered to a backing sheet on which they are deposited on the production conveyor line. The overall insulating strips are commonly 15 inches or 23 inches wide with the thickness of the compressible insulating layers varying from two inches to six inches. It will be readily understood that a lengthy roll of such a strip, capable of covering 50 to 75 square feet, by way of example, can be quite bulky if not compressed substantially when packaged. This is equally true if a number of shorter strips or batts are packaged in end-to-end relationship. In fact, the packaging should be limited only be the degree to whcih the fibers can return substantially to the original thickness after the packaged roll is opened. Heretofore, such strips have usually not been compressed to the maximum extent possible, short of causing permanent deformation of the fibrous layer. The belt forming the loop in which the strip is packaged also applies more uniform pressure around the strip than apparatus heretofore known. The more uniform pressure produces less "cold working" of the fibers and thereby increases their ability to return to their original thickness from a more highly compressed state. Hence, longer strips can be packaged in the diameter previously used, or the same length of strip can be employed with a smaller diameter package resulting.

A frame is located beyond the upper end of the inclined conveyor on which is carried an endless movable belt. The belt is positioned and driven so that a loop or pocket is formed therein in alignment with the upper end of the inclined conveyor. The compressible strip is moved onto and up the inclined suction conveyor with the end received into the loop, with the belt being moved in a manner such that the strip is rolled on itself with the backing sheet, if any, facing outwardly. The belt is maintained under tension as the roll is wound so that increasing pressure is maintained on the roll as the loop enlarges to accommodate the ever-increasing diameter of the roll being packaged. The compressible strip is cut to a predetermined length on the production line and as the trailing end of the strip moves up the inclined conveyor, tape is applied thereto, with a portion of the tape adhered to the trailing end of the strip and a portion of the tape extending rearwardly thereof. The latter portion of the tape is adhered to the previous wrap of the strip as it is carried with the strip into the loop of the belt. It has been found by employing two tapes for each package, no additional overwrap is required, which constitutes a nuisance since it must be disposed of by the contractor at the building site. Consequently, the roll is completely packaged by the time the strip moves into the loop and turns approximately one more revolution to cause the tape to adhere to the previous wrap. At this time, a portion of the frame is swung away to straighten the portion of the belt forming the loop and to cause the roll to be ejected downwardly. Up to this point, the insulation is not touched at all by human hands.

A multi-zone, suction conveyor is used to feed the compressible strip into the loop and also the tapes. This conveyor provides a firm grip on the strip when moving it into the loop and also maintains the tapes in proper position on the conveyor during the movement. The multi-zone conveyor also provides a grip on the forward end or trailing end of the strip even when the strip does not cover the entire conveyor and the suction holes on the conveyor belt are not all covered.

It is, therefore, a principal object of the invention to provide improved apparatus for packaging compressible material in strip form.

Another object of the invention is to provide apparatus for packaging a compressible strip in roll form under greater compression than heretofore.

A further object of the invention is to provide apparatus for packing a compressible strip by the use of tapes without an overwrap.

Yet another object of the invention is to provide apparatus including a multi-zone, suction conveyor for feeding a compressible strip into a loop for packaging.

Still another object of the invention is to provide apparatus for rolling up a compressible strip and for automatically applying tape to the strip.

Yet a further object of the invention is to provide apparatus for automatically packaging two or more compressible strips received in side-by-side or end-to-end relationship directly from an end of a production line.

Still a further object of the invention is to provide apparatus for packaging a plurality of strips or batts into a roll in end-to-end relationship.

Many other objects and advantages of the invention will be apparent from the following detailed description of a preferred embodiment thereof, reference being made to the accompanying drawings, in which.

Figure 1:
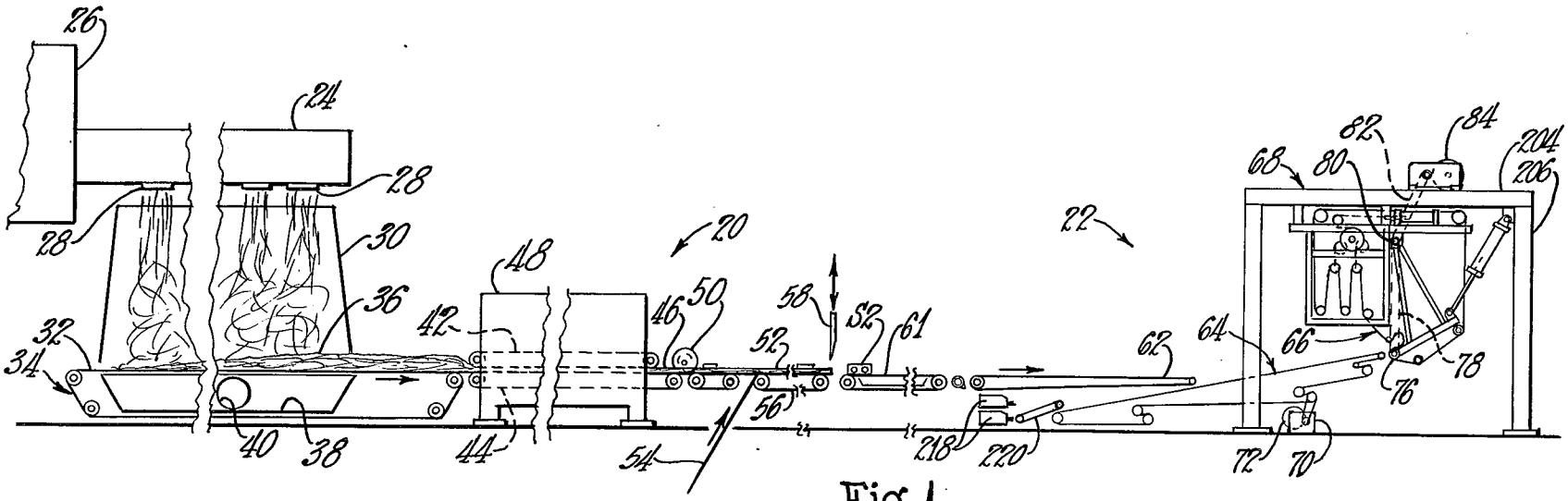
FIG. 1 is a schematic, fragmentary side view in elevation of a production line and packaging apparatus embodying the invention.
Figure 8:
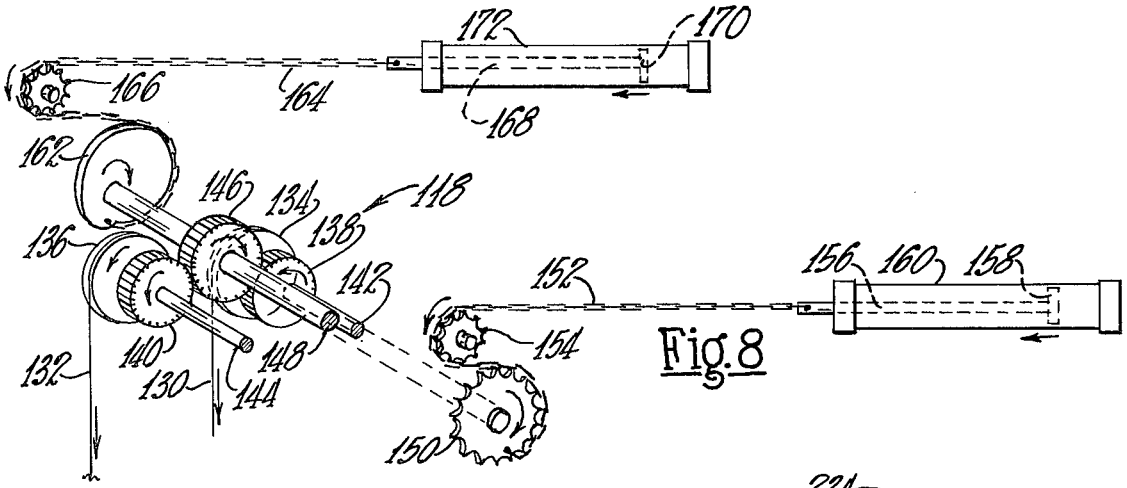
Figure 9:
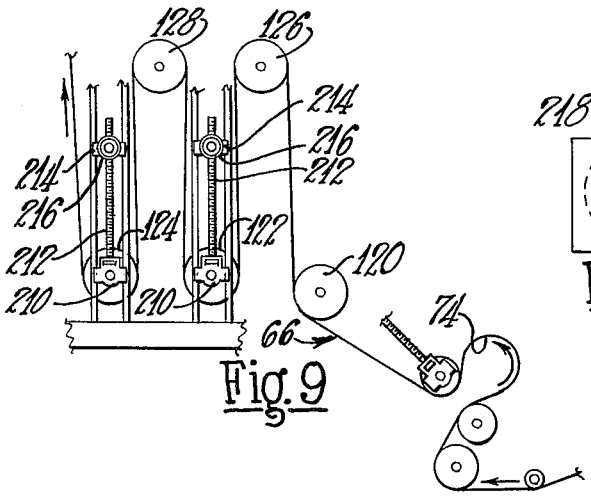
Figure 10:
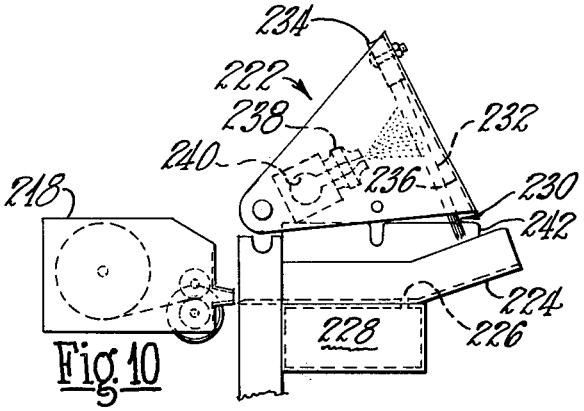
Figure 11:
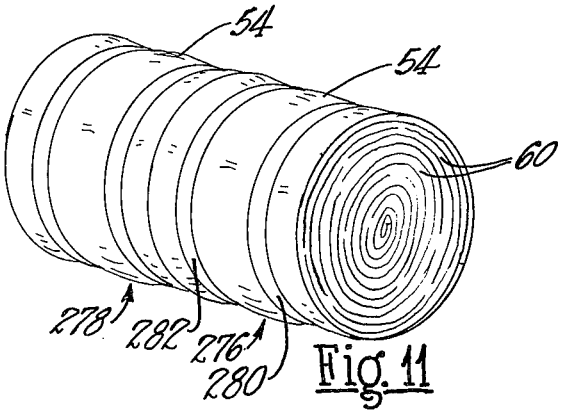
Figure 12:
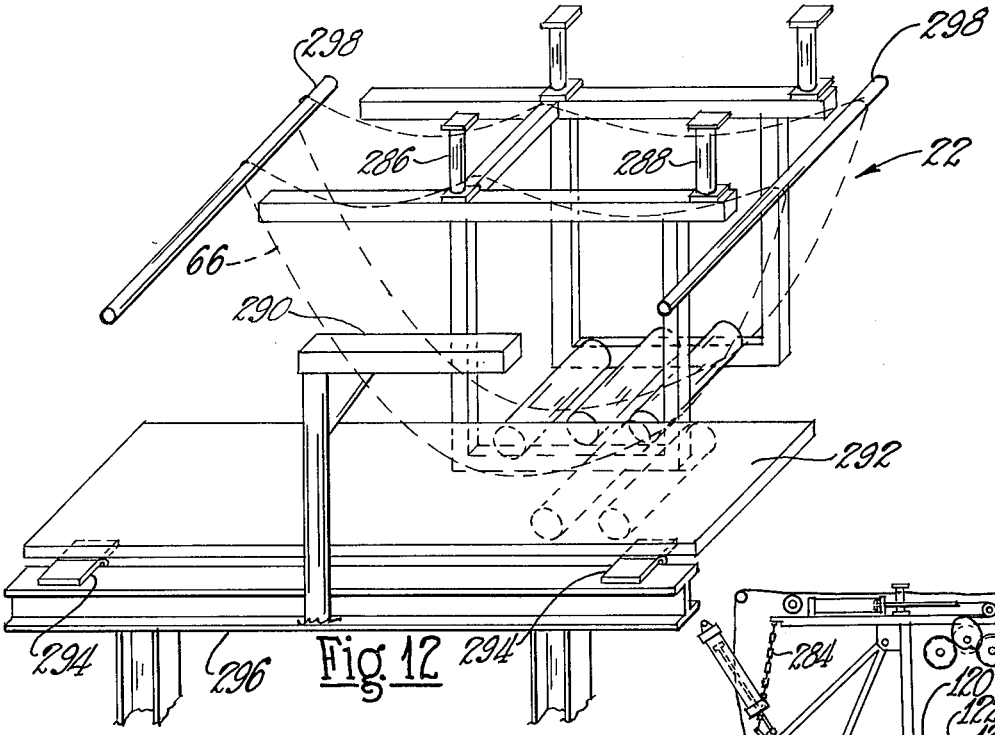
Figure 14:
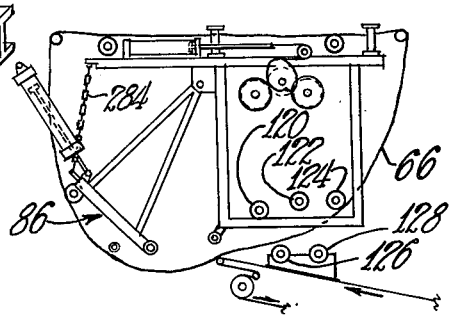
Figure 13:
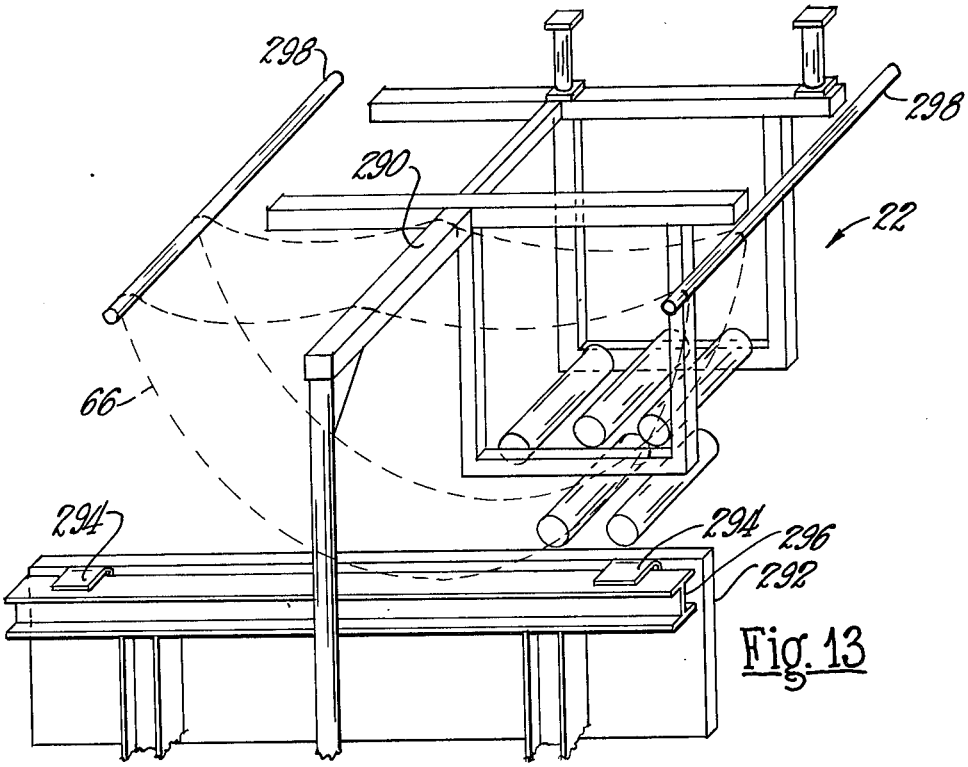

FIGS.. 4–7 are further enlarged, somewhat schematic side views in elevation of a portion of the packaging apparatus and showing various components thereof in different positions during the packaging and discharge of a strip of compressible material received from the production line;

FIG. 8 is a somewhat schematic view in perspective of apparatus for maintaining tension on an endless belt of the packaging apparatus;

FIG. 9 is a detailed, schematic view in elevation of an adjustable take-up which is part of the tension apparatus of FIG. 8;

FIG. 10 is a fragmentary, side view in elevation of a portion of tape dispensing apparatus for applying tape to the trailing edge of the compressible strip;

FIG. 11 is a view in perspective of two adjacent packages of compressible strip as they exist when ejected from the packaging apparatus;

FIG. 12 is a schematic view in perspective of the packaging apparatus, from the side opposite that of FIG. 1, showing means for facilitating removal of the endless belt;

FIG. 13 is a view similar to FIG. 12 but showing certain components in another position; and FIG. 14 is a schematic side view of the apparatus showing the belt about to be installed.

Referring to FIG. 1, a production line on which a compressible strip, specifically building insulation, can be produced is indicated at 20 and packaging apparatus for packaging the compressible strip is indicated at 22. The production line 20 is of a substantially conventional design and construction and will be discussed only generally. A forehearth 24 receives heat-softened glass or other flowable, fiber-forming material from a melting furnace 26 of a suitable, known design in which raw material is reduced to a flowable or molten state. The molten glass is fed to fiber-forming units 28 located beneath the forehearth 24. The units 28, by way of example, can be hollow, rotatable members or spinners having orifices in the peripheries through which glass is attenuated into primary fibers. The primary fibers are then further attenuated and directed downwardly by hot gaseous blasts from blowers or burners (not shown) located adjacent the units 28. The fibers move downwardly through a forming hood 30 and are sprayed with binder by suitable spray devices (not shown) which direct the binder into the forming hood transversely of the fiber path. The fibers are then received on an upper flight 32 of a foraminous, endless belt conveyor 34, the fibers being collected as a mass or layer 36 of an approximate predetermined thickness, and are carried along the conveyor 34 toward the right, as viewed in FIG. 1. A suction chamber 38 is located below the upper flight 32 of the conveyor, with an exhaust conduit 40 connected to a suction blower (not shown) for establishing a reduced pressure in the chamber 38. The reduced pressure or suction assists in the collection of the fibers on the flight 32 and also carries away the spent gases of the attenuating blasts and organic particles from the binder.

The layer 36 of the fibers is advanced to a region between upper and lower foraminous belts 42 and 44 which are positioned to compress the fibers somewhat into a fibrous layer or body 46 of predetermined thickness. The foraminous belts 42 and 44 convey the fibrous layer through an oven or heating chamber 48 in which the binder is set or partially cured on the fibers at a temperature in the order of 450°–500°F. When the layer 46 emerges from the oven 48, the edges are trimmed by suitable rotatable knives 50 which remove uneven edge strips from the layer 46. In this instance, a center one of the rotatable knives 50 can also be provided to sever the formed layer 46 into two narrower fibrous layers 52. A plow (not shown) can be used to spread apart the two layers 52 somewhat to leave a gap therebetween. At this time, a coated kraft paper or similar backing sheet 54 can be applied to each of the layers 52, these sheets being fed upwardly and underneath the layers 52. The sheets can have an adhesive suitably applied to the upper sides thereof prior to being fed into contact with the layers 52 to provide adhesion therebetween. The adhesive can also help serve as a vapor barrier for the resulting insulation and can also contain a suitable fire retardant.

The combined layers 52 and backing sheets 54 are then carried along a discharge conveyor 56 and under a cut-off knife 58 which cuts the layers 52 and the sheets 56 into building insulation strips 60 (FIGS. 4–6) of predetermined length, being long or short, the short strips being commonly known as batts. The insulation 60, which constitutes compressible strips in this instance, is carried from the discharge conveyor 56 onto a conveyor 61 and supply conveyor 62 of the packaging apparatus 22. The insulation 60 is then moved up an inclined suction conveyor 64 toward an endless belt 66 carried by a frame 68. The conveyor 64 can be driven by a suitable gear reducer mechanism 70 and a drive motor 72. The conveyors 61, 62, and 64 move at a speed in excess of the conveyors of the line 20 since each compressible strip of insulation must be discharged after being packaged, thus resulting in a delay which must be compensated for by the faster packaging speed for the insulation. Actually, the belt 66 and the three conveyors 61, 62, and 64 move at increasing speeds from the cut-off knife 58 to the loop. By way of example, assuming the speed of the belt 66 at the loop is 100 percent, the speed of the suction conveyor 64 is 98–99 percent, and the conveyors 61 and 62 are 80–90 percent. By way of example, the speed of the conveyor 56 of the production line 20 can be 210 feet per minute with the endless belt 66 operating at 500–550 feet per minute. With the loop speed being the fastest, a controlled slippage occurs between the belt and the strip which prevents buckling at the loop.

The belt 66 has a loop or pocket 74 formed therein which is in alignment with the slanted conveyor 64 to receive the forward ends of the compressible strips of insulation 60. The belt 66 is driven by a drive roll 76 (FIGS. 4–7) which in turn, is driven by suitable means such as a chain 78 (FIG. 1), idler sprockets 80, a drive chain 82, and a drive unit 84 located on an upper portion of the frame 68. The drive roll 76 is carried by a pivotable sub-frame 86 (FIGS. 4–7) comprising a lower supporting frame bar 88 and two struts 90 and 92 pivotally mounted by a pivot pin 94 which is held by an ear portion 96 of the frame 68. Actually, there is one of the bars 88 and one of each of the struts 90 and 92 on each side of the packaging apparatus 22, beyond the ends of the drive roll 76. The drive roll 76 also drives a bend roll 98 and a number of supporting rolls 100 through a plurality of V-belts 102, seven of such belts being used in the particular instance. These belts and rolls support the lower portion of the belt loop 74 as it expands, and helps continue expansion of the loop in the direction shown. The rolls 98 and 100 are also supported by the supporting frame bar 88 through suitable side plates (not shown) extending upwardly from the bar 88.

The belt 66 is held against the periphery of the drive roll 76 by a pinch roll 104 which is rotatably carried by a lever 106 pivotally mounted on an axle 108 which also rotatably carries the bend roll 98. The lever 106 is operated through a pneumatic cylinder 110, being connected to a piston rod 112 thereof. The pinch roll 104 forces the belt 66 into driving contact with the drive roll 76 when the piston rod 112 is retracted into the cyliner 110. The timing of the operation of the pinch roll 104 is important in forming the loop 74, as will be discussed more fully subsequently.

Figure 7:
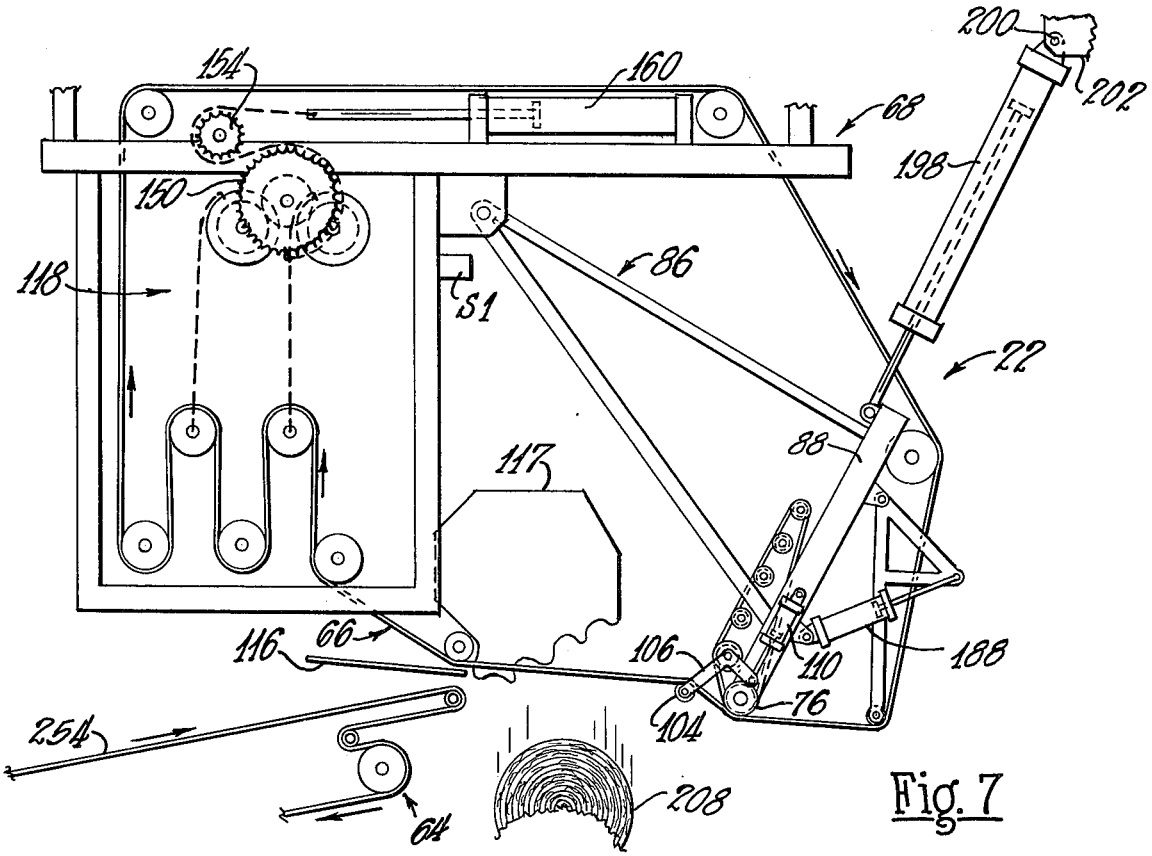

Beyond the loop 74, in the direction of movement of the belt 66, the belt bends around a throat roll 114 located above an adjustable plate 116 which helps to direct the forward edge of the insulation 60 between the rolls 98 and 114. The plate also prevents the insulation from contacting the belt 66 above the throat roll 114 which would tend to kick the insulation up and away from the loop 74. Side plates 117 are also employed at the sides of the belts 102 to prevent telescoping of the insulation 60, particularly when two or three narrower strips are packaged instead of a single wide one. The plates are adjustable in and out to control the spacing therebetween. As shown in FIG. 7, even the lower edges of the side plates 117 are contoured around the supporting rolls 100 to prevent the possibility of the insulation 60 being squeezed out therebetween.

Figure 4:
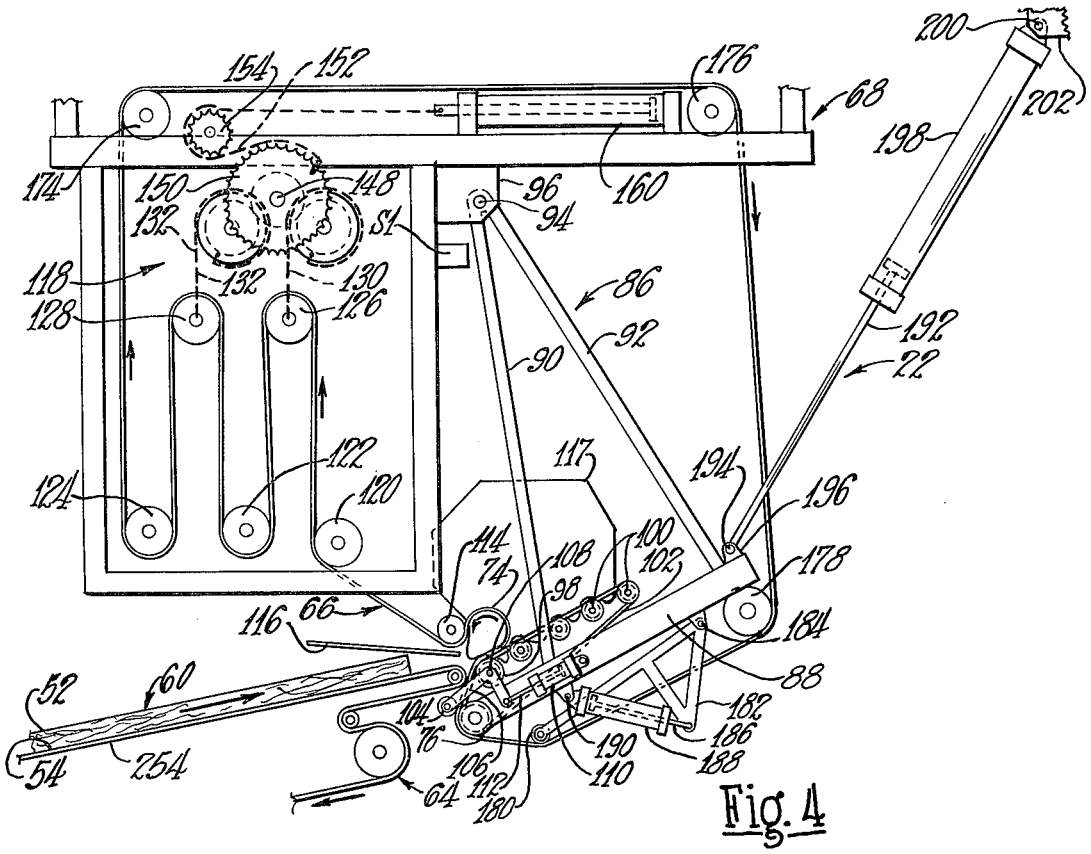
Figure 5:
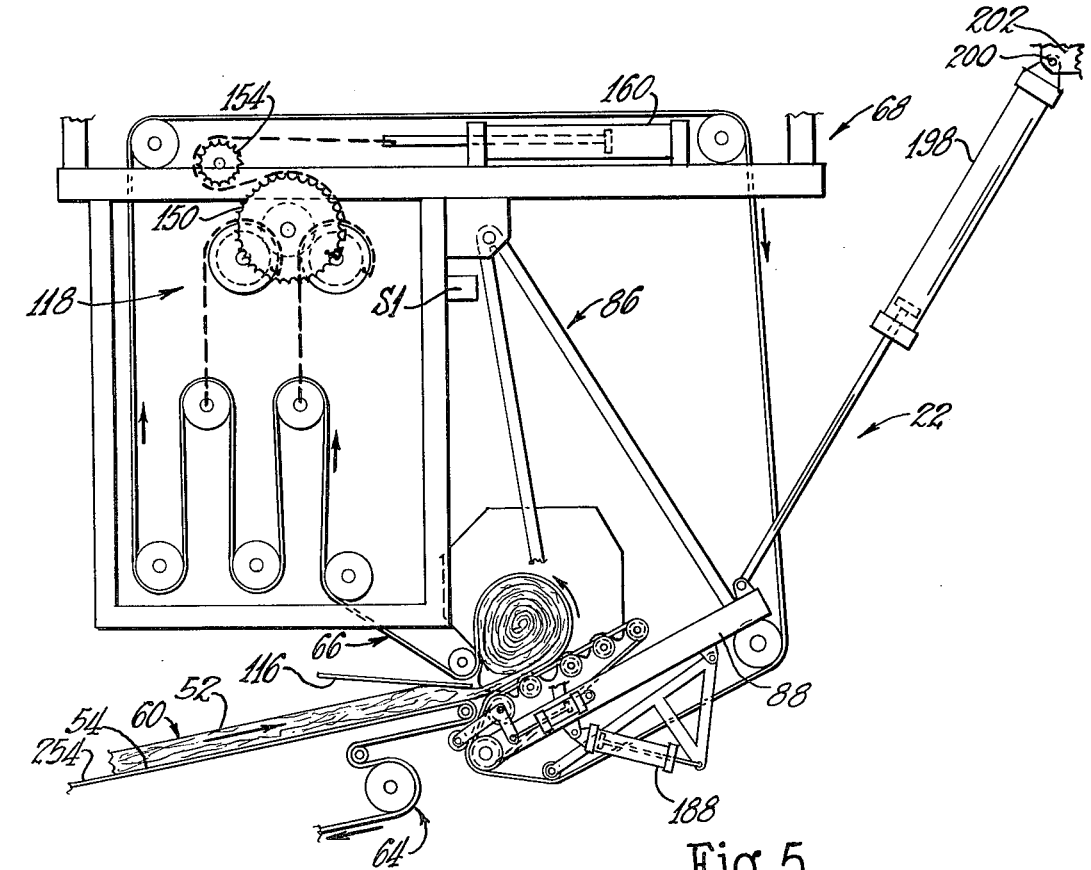

It is important that the belt 66 be allowed to expand at the loop 74 as the insulation rolls up therein and yet tension must be maintained on the belt 66 in order to maintain compressive force or pressure on the insulation 60 as each wrap is rolled. For this purpose, a take-up or tension mechanism indicated at 118 is carried by the frame 68. Referring to FIGS. 4, 8 and 9, the take-up mechanism 118 includes stationary idler rolls 120, 122, and 124 and two upper, vertically-movable take-up rolls 126 and 128. The rolls 126 and 128 are urged upwardly to place the belt 66 under tension but move downwardly as the size of the loop 74 increases to enable the loop to properly accommodate the ever-increasing size of the package being formed.

Figure 6:
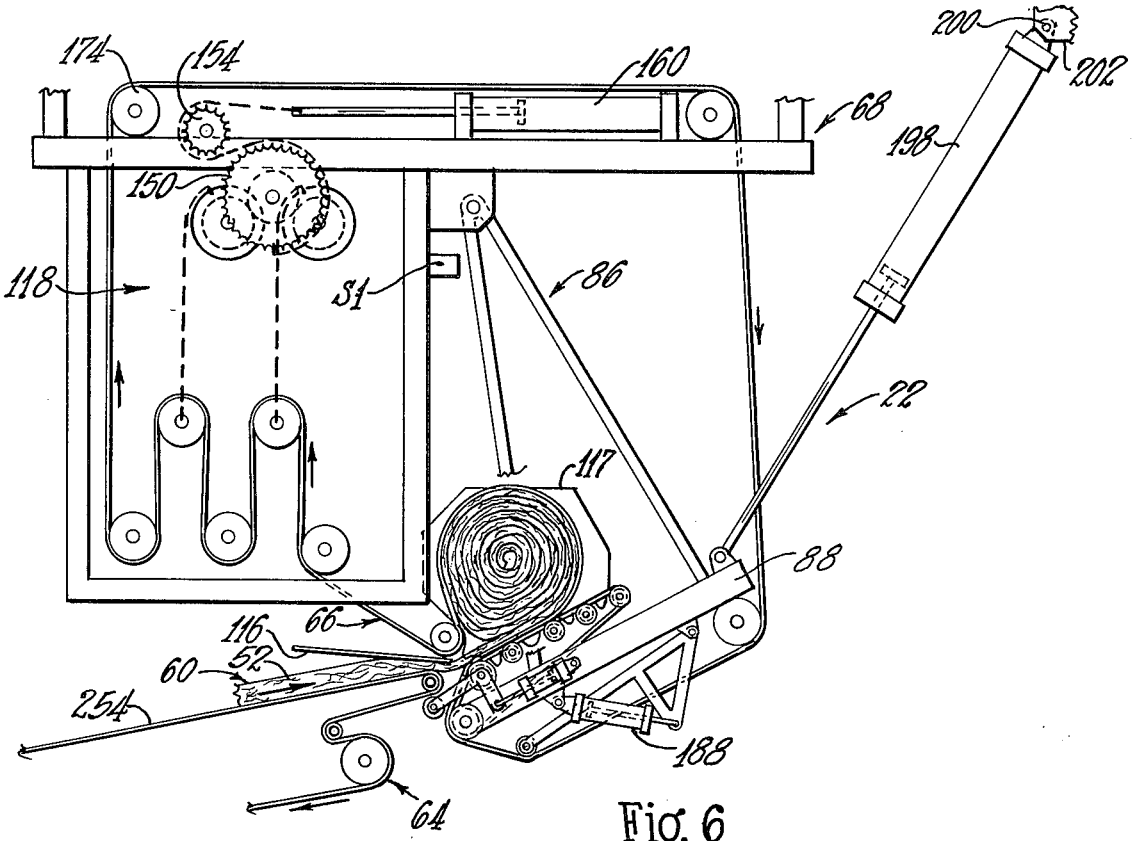

The take-up rolls 126 and 128 are supported by chains 130 and 132 which are wound on sprockets 134 and 136. The chains do not extend completely around the sprockets but only sufficiently far to enable the take-up rolls 126 and 128 to move between their extreme upper positions, as shown in FIG. 4, and their extreme lower positions, as shown in FIGS. 6 and 7. The sprockets 134 and 136 are affixed to spur gears 138 and 140, respectively, with the sprockets and gears rotatably mounted on axles 142 and 144. The gears 138 and 140, in turn, are engaged by a common drive gear 146 keyed to a shaft 148. There is a set of the gears 146, 138, and 140, the sprockets 134 and 136, and the chains 130 and 132 at each end of the take-up rolls. A drive sprocket 150 is affixed to one end of the shaft 148 with a chain 152 affixed and extending partly around the sprocket 150 and around an idler sprocket 154. The other end of the chain is connected to a piston rod 156 of a piston 158 in a fluid-operated cylinder 160. The pressure in the cylinder 160 is adjusted so that the torque exerted on the sprocket 150 will substantially offset the weight of the take-up rolls 126 and 128 of the take-up mechanism.

A cam member 162 is affixed to the opposite end of the shaft 148 and has a chain 164 extending partly therearound and affixed thereto, and extending around an idler sprocket 166. The opposite end of the chain 164 is connected to a piston rod 168 of a piston 170 in a fluid-operated cylinder 172. The cam member 162 is designed to provide a wide variation in torque, by variation in the length of the torque arm as measured between the shaft 148 and the point of tangency of the chain 164 on its periphery. The torque arm is small, e.g. 2 inches, when the take-up rolls 126 and 128 are in their upper positions and the torque arm increases rapidly as the take-up rolls move downwardly, e.g. to a maximum of 12 inches, the maximum being from 2 to 6 times the minimum, and more specifically 3 to 4 times the minimum. With a constant pressure for the cylinder 172, the tension on the belt 66 is low initially and increases rapidly as the take-up rolls 126 and 128 move lower. If desired, the design of the cam member 162 enables the tension on the belt 66 at the loop 74, when the loop is small, to be relatively low. The belt then can yield more readily as the insulation initially enters it to enable the package to be initially formed more easily and more smoothly than with higher intial tension on the belt. The tension then increases as the loop diameter increases to place additional pressure on the insulation as the package increases. However, the cam member 162 can be shaped to provide even less pressure on the package, if desired, as it increases in size.

Beyond the take-up mechanism 118, the belt continues upwardly around a split idler guide roll 174 (FIG. 4), moving back across the top of the frame 68, and around an idler roll 176. The belt continues downwardly around a lower split idler guide roll 178 carried by the pivotal frame 86. Finally, the belt extends around a slack control roll 180 (FIGS. 4 and 7) back to the drive roll 76. Each end of the slack control roll 180 is rotatably carried by a lever 182 which is pivotally mounted by a pin 184 to the supporting bar 88. The lever 182 is pivotally moved by a piston rod 186 extending from a cylinder 188 which is also pivoted by a pin 190 to the bar 88. The roll 180 acts as an idler or brake on the belt 66 immediately adjacent the drive roll 76 as the package is being built up, and the roll 180 also controls the slack in the belt when the frame 86 is opened, as will be discussed subsequently.

When the roll is complete and elongate, flexible materials in the form of tapes to be discussed subsequently, have been wrapped thereon, the roll is automatically discharged. For this purpose, a piston rod 192 (FIG. 4) is pivotally connected by a pin 194 to an ear 196 at each of the rear corners of the pivotable frame 86. The piston rod 192 extends into a cylinder 198 which is pivotally connected by a pin 200 to an ear 202 at the upper rear corner of the frame 68 formed by beams 204 and 206. The pivot pin 200 is spaced substantially to the rear of the pivot pin 94 for the frame 86. Consequently, when fluid is supplied to the rod end of the cylinder 198 and the piston rod 192 is retracted, the frame 86 pivots in a counterclockwise direction to the position of FIG. 7. At this time, the fluid-operated cylinder 110 is operated through sensing means, such as a proximity switch S1, to extend the piston rod 112 and move the pinch roll 104 outwardly. This immediately reduces the engagement of the drive roll 76 with the belt 66, substantially stopping it. At the same time, the switch S1 causes fluid to be supplied to the blind end of the cylinder 188 to extend the piston rod 186 and move the slack control roll 180 in a counterclockwise direction. This takes up substantially all slack in the belt 66 and eliminates the loop 74 for the time being, causing a package 208 to be discharged downwardly from the apparatus 22.

After discharge, the piston rod 192 is extended once again and the piston rod 186 retracted. As the frame 86 approaches its original position of FIG. 4, the proximity switch S1 causes the piston rod 186 to retract to place slack in the belt 66 upstream of the loop 74, and causes the piston rod 112 to retract to enable the pinch roll 104 to again squeeze the belt 66 between it and the drive roll 76. This causes the belt to immediately begin to move and causes a portion to project between the rolls 98 and 114, forming the loop 74 again. The operation of the pinch roll 104 thereby is important in enabling the loop 74 to be formed. The apparatus 22 is then in its receiving position and ready to form a package from the next compressive strip or strips cut off by the knife 58.

The initial size of the loop 74 can be adjusted by controlling the positions of the stationary rolls 122 and 124. As shown in FIG. 9, this can be accomplished through bearing blocks 210 for the rolls which are connected through screws 212 to threaded, fixed supporting members 214 having adjustable hand wheels 216 to move the screws 212 up and down relative to the fixed members 214.

To maintain the roll of the compressible strip in compression, two lengths of tape are preferably applied to the backing sheets of each roll. The length of tape preferably should be applied so that about one-half the length is adhered to the trailing end portion of the insulation 60 while the other half can be applied to the backing sheet of the previous wrap of insulation as the roll is rotated in the loop or pocket 74. However, variations in the application of the tapes are possible. The tape can even be wrapped completely around the package to overlap the joint thereof twice.

Referring to FIG. 1, two banks of tape dispensers 218 are located below the conveyor 62. A tape transfer conveyor 220 is located in front of the dispensers 218 and is positioned to receive tape from the bank which is in operation. The two banks enable one bank to be refilled, serviced, etc. while the other is in use. For this purpose, each of the two banks of dispensers can be mounted on rails extending transversely of the conveyors. For servicing, the appropriate bank is simply pulled out to one side of the conveyor for ready access. Tape from the dispenser 218 is fed lineally along the transfer conveyor 220 to a lower end of the inclined conveyor 64.

In the dispensers 218, the tape is dispensed with the glue or adhesive side facing upwardly. To properly activate the glue on the upper surface of the tape, a special applicator indicated at 222 in FIG. 10 is employed. A tape trough 224 is mounted in front of the dispensing opening of the dispenser 218 with a suitable drain opening 226 therein for returning water to a tank or receptacle 228. A soft bristle brush 230 has bristles 232 and a head 234 which is affixed to a housing 236. Water is sprayed from a spray head 238 having a supply line 240 extended to a suitable source (not shown) with the water directed onto the bristles 232 from which the water flows uniformly downwardly and onto the tape in the trough 224. Baffles 242 are located at the sides of the trough 224. Water intercepted by the baffles flows to the side and through the drain opening 226. With this arrangement, the water is uniformly and rapidly applied to the upper side of the tape. With the special applicator 222 and the dispensers 218, the tape can be dispensed ready for applying at speeds in excess of 40 inches per second. The tapes are fed out along the conveyor 220 and the inclined conveyor 64 until their upper ends are near the conveyor 62. At this point, the tapes would tend to be dragged along the conveyor 64 but the opposite ends of the tapes are still held within the dispensers 218 so that the tapes remain until the other ends are cut. At that time, the tapes are carried up the conveyor 64 into contact with the insulation 60 or, when used, the backing sheets 54 of the insulation 60, and are carried therealong into the loop 74. The timing of the tapes and lengths thereof are such that one-half of each of the tapes is affixed to the trailing end of the insulation and the other half is wound around and affixed to the insulation or the backing sheet of the adjacent wrap of insulation. This provides a secure package with a minimum amount of tape and yet a package which maintains the high compressive forces on the insulation after the package is complete.

The tape transfer conveyor 220 includes a perforated belt 244 and a vacuum chamber 246 communicating with the upper run of the perforated belt. A vacuum is established in the chamber 246 by a source (not shown) connected therewith by a flexible exhaust hose 248. The belt 244 extends around a head pulley 250 and a tail pulley 252 with the conveyor pivoting around the shaft of the tail pulley 252 to align the conveyor with either of the banks of the tape dispensers 218. The vacuum holds the tape down on the conveyor more effectively and prevents the tape from being deflected transversely by air currents.

Figure 2:
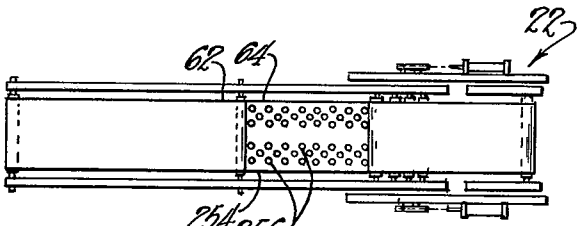
FIG. 2 is a somewhat schematic top view of the packaging apparatus of FIG. 1.
Figure 3:
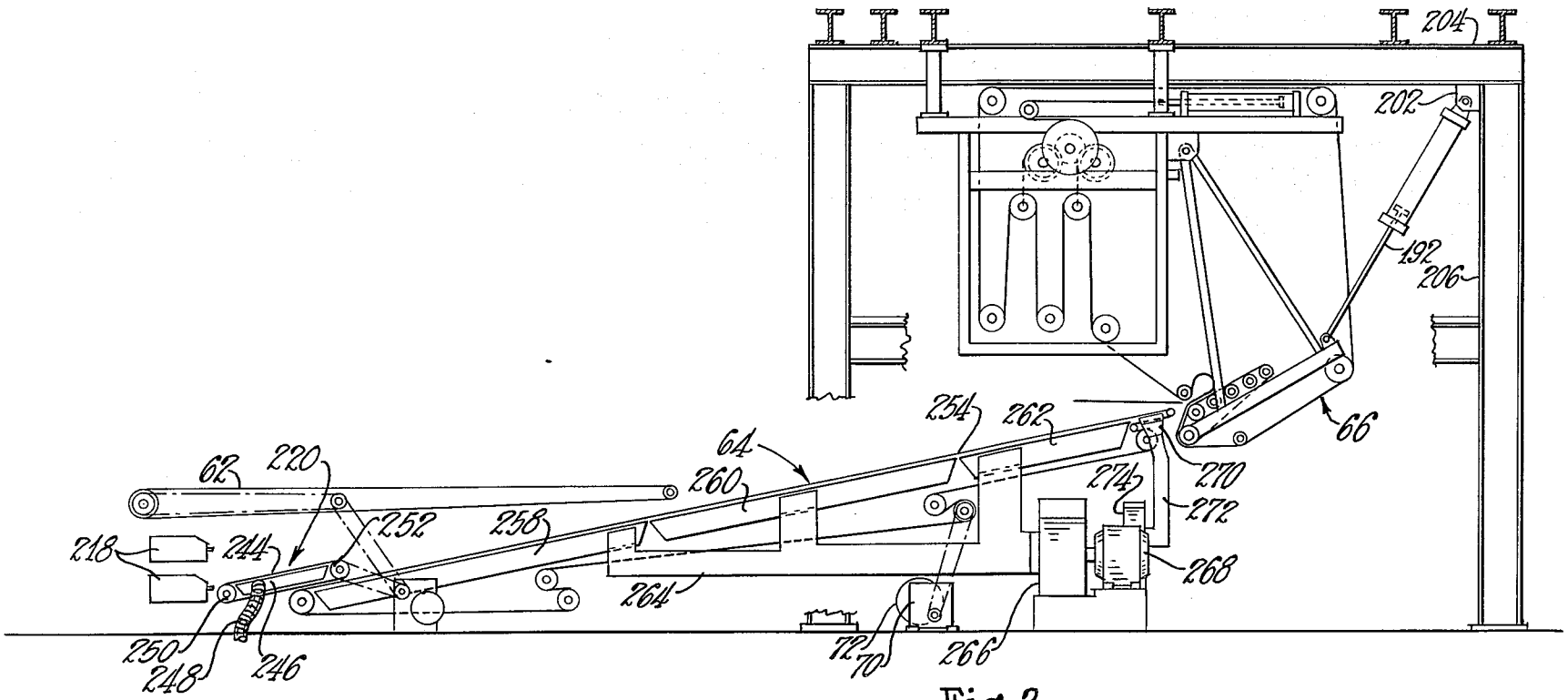
FIG. 3 is an enlarged, somewhat schematic, side view in elevation, with parts broken away, of the packaging apparatus of FIGS. 1 and 2.

As shown in FIG. 3, the conveyor 64 also employs vacuum. The conveyor 64 has a perforated belt 254 with staggered openings 256, as shown in FIG. 2. The conveyor 64 also has several, three as shown, vacuum zones formed by vacuum chambers 258, 260, and 262 to provide a better grip on the insulation 60 which otherwise has a tendency to float when traveling at high speed up the conveyor. The vacuum chamber 260 enables the conveyor to grip a leading edge portion of the insulation even though the upper chamber 262 is not covered. Similarly, the trailing edge portion of the insulation will be gripped with the aid of the vacuum chamber 262 even though the lower chamber 260 is not covered. The first zone formed by the chamber 258 under the conveyor 62 grips the tapes and holds them in position as they move upwardly on the conveyor 64 and into contact with the insulation beyond the conveyor 62. Vacuum for the three chambers 258, 260, and 262 can be established through suitable ductwork 264 connecting the chambers to a blower 266 driven by a motor 268.

Immediately before the loop 74 is a final suction zone on the conveyor 64 established by a suction chamber 270 connected by ductwork 272 to a separate blower 274. The final suction zone provides an extra grab on the insulation and a final thrust as it enters the loop.

Two final packages 276 and 278 are shown in FIG. 11 in the form they are discharged from the apparatus. Each package can contain one long length of the compressible insulating strips or a number of short compressible insulating strips or batts in end-to-end relationship. They are discharged in contiguous, side-by-side relationship with the wraps of the insulation 60 and the backing sheet 54 being in alignment to provide flat ends on the packages, the wraps being restrained by the side plates 117. Two tapes 280 and 282 are located on each of the packages 276 and 278 and preferably extend completely therearound. The two tapes are employed with either 15-inch wide or 23-inch wide insulation when no additional overlap is used. The tapes are 3- to 4-inches wide and are located near the edges of the packages, as shown. If reinforced, the tapes can be as narrow as 2 inches. The tapes cover from 15 to 60 percent of the width of the package and preferably from 30 to 50 percent of the width. When the packages of insulation are to be used, the tapes 280 and 282 can be simply severed at the trailing edge of the insulation and the insulation installed with the tapes left adhered thereto. With this arrangement, there is no additional overwrap which must be removed and subsequently disposed of, not an easy operation especially when burning of it is prohibited.

The overall operation of the packaging apparatus 22 will now be discussed. When the leading edge of the insulation 60 passes a pair of electric eyes or other sensing device S2 located beyond the cut off knife 58, a first, tape delay timer is started which provides a short delay and then starts a second, tape length timer. At this time, the tape dispensers 218 feed out tape and continue to do so until the tape length timer times out. The forward ends of the tape at this time are on the inclined conveyor 64. When the trailing edge of the insulation 60 passes the electric eye sensing device S2, a tape cut-off delay timer starts. When this timer times out, the tape is cut and at the same time a fourth, delay eject timer starts. When the tape is cut, it is carried into the loop 74 with the trailing edge of the insulation. After the delay eject timer times out, it actuates the cylinders 198 for the pivotable frame 86 and causes it to swing out and discharge the packaged roll. By this time, the tape will have been wound onto the adjacent wrap of the backing sheet of the insulation. The cylinders 110, 160, 172, and 188 also will operate through their cycles. The cylinders are actuated temporarily so that the frame 86 and the various components return to the position of FIG. 3 ready to receive another of the compressive strips in a minimum of time.

From time to time, the endless belt 66 must be replaced because of wear or damage. For this purpose, the packaging apparatus 22 is equipped with special provisions, as shown in FIGS. 12–14. To remove the belt 66, the pivotal frame 86 is swung to a partially-open position, as shown in FIG. 14, and held by a chain 284. The upper take-up rolls 126 and 128 are then lowered between the lower rolls 122 and 124 to clear the belt 66. The various interfering components such as the pinch roll, a chute, guards, cylinders and lines are then removed as necessary to clear the belt. Two overhead hangers or beams 286 and 288 which normally support the apparatus frame from the overhead support 204 are removed after a supporting boom 290 is swung into place, as shown in FIG. 13. A workmen's platform 292, located about half-way up the apparatus 22, is hinged by hinges 294 to a suitable supporting frame 296. Bolts at the opposite longitudinal edge of the platform 292 are removed and the platform 292 is swung down to a vertical position. The belt 66 can then be removed, being slid to the side of the apparatus on elongate yoke members 298. When the belt is to the side, the supporting beams 286 and 288 can be replaced, the boom 290 swung out of the way to the position of FIG. 12, and the belt then lowered past the hinged platform 292. For installing the new belt, the above procedure is generally reversed.

Various modifications of the above-described embodiment of the invention will be apparent to those skilled in the art, and it is to be understood that such modifications can be made without departing from the scope of the invention, if they are within the spirit and the tenor of the accompanying claims.

We claim:

1. Apparatus for rolling and compressing a flexible, compressible strip, said apparatus comprising an endless belt, a portion of said belt defining a loop, means for feeding an end of the strip into the loop, means for moving said belt, means for placing said belt under tension to place the strip in compression as it is rolled in the loop, means for discharging the rolled strip from said loop by opening said loop after the strip is rolled up, tape-dispensing means for feeding tape toward said loop, a pivotable suction conveyor between said tape-dispensing means and said loop, said tape-dispensing means comprising two groups of tape dispensers on two different levels, and said pivotable suction conveyor being pivotably movable between the groups of dispensers.

2. Apparatus according to claim 1 characterized by said means for feeding an end of the strip into the loop includes an additional suction conveyor.

3. Apparatus according to claim 2 characterized by said additional suction conveyor having at least two separate vacuum zones positioned lengthwise of the conveyor.

4. Apparatus according to claim 3 characterized by said additional suction conveyor having at least one additional vacuum zone immediately preceding the point of discharge from the additional suction conveyor toward the loop.

5. Apparatus according to claim 2 characterized by a third conveyor upstream of said additional suction conveyor, a cut-off knife upstream of said third conveyor, means for moving said additional suction conveyor at a speed less than that of said belt, and means for moving said third conveyor at a speed less than that of said additional suction conveyor.

6. Apparatus according to claim 5 characterized by the speed of said additional suction conveyor being 98–99 percent of the speed of said belt, and the speed of said third conveyor being about 80–90 percent of the speed of said belt.

7. Apparatus for rolling and compressing a flexible, compressible strip into a roll, said apparatus comprising an endless belt, means for supporting and driving said belt in a manner to define a loop therein, means for feeding an end of the strip into the loop, means for discharging the rolled strip from said loop after the strip is rolled up, means for placing said belt under controlled tension to supply substantially uniform pressure to the strip being rolled as the loop increases in size, said tension means comprises a stationary roll, a take-up roll movable toward and away from said stationary roll, said belt extending around said stationary roll and said take-up roll, a shaft connected with said take-up roll, first means associated with said shaft for urging said shaft in a direction to urge said take-up roll away from said stationary roll with a force substantially offsetting the weight of said take-up roll and the associated portion of said belt, and second means associated with said shaft for urging said shaft in a direction to urge said take-up roll away from said stationary roll with the torque applied to said shaft by said second means changing as said take-up roll moves toward said stationary roll as the loop increases in size.

8. Apparatus according to claim 7 characterized by the torque applied by said second means to said shaft when the loop is at its maximum diameter is from two to six times the torque applied to said shaft when said take-up roll is in its maximum position away from said stationary roll and the loop is of its smallest diameter.

9. Apparatus according to claim 7 characterized by the torque applied by said second means to said shaft when the loop is at its maximum diameter is from three to four times the torque applied to said shaft when said take-up roll is in its maximum position away from said stationary roll and the loop is of its smallest diameter.

10. Apparatus according to claim 7 characterized by said second means comprises a cam member affixed to said shaft, a flexible member attached to said cam member and extending partly therearound, and means for placing said flexible member under tension.

11. Apparatus according to claim 10 characterized by the distance from said shaft to the point of tangency of said flexible member being a maximum when the diameter of the loop is a maximum and being a minimum when the diameter of the loop is a minimum.

12. Apparatus according to claim 11 characterized by the maximum distance of said cam member being from two to six times the minimum distance.

13. Apparatus for rolling and compressing a flexible, compressible strip into a roll, said apparatus comprising an endless belt, means for supporting and driving said belt in a manner to define a loop therein, means for feeding an end of the strip into the loop, means for discharging the rolled strip from said loop after the strip is rolled up, means for placing said belt under increasing tension to supply greater pressure to the strip being rolled as the loop increases in size, said tension means comprises at least two stationary rolls, an intermediate, take-up roll positioned therebetween and movable toward and away from said stationary rolls, said belt extending around one of said stationary rolls, around said take-up roll, and around the other of said stationary rolls, means for urging said take-up roll in a direction away from said stationary rolls, said urging means comprising a first elongate, flexible member connected with said take-up roll, a shaft, first means on said shaft spaced from said take-up roll around which a portion of said flexible member is wrapped, tensioning means connected with said shaft, a second flexible member wrapped partly around said tensioning means, means for placing said second flexible member under tension resulting in a force on said first elongate, flexible member which is insufficient to prevent movement of said take-up roll toward said stationary rolls as the loop increases in size, said tensioning means comprising a cam member shaped so as to present a short torque arm for said second flexible member when said loop is small and a longer torque arm for said second flexible member when said loop is larger, and additional means connected with said shaft for urging said first means in a direction urging said take-up roll away from said stationary rolls.

14. Apparatus according to claim 13 characterized by said additional means comprises a circular member, a third flexible member having a portion wrapped on said circular member, and additional means for placing said third flexible member under tension to substantially offset the weight of said take-up roll and the associated portions of said belt.

15. Apparatus for rolling and compressing a flexible, compressible strip, said apparatus comprising an endless belt, means for forming a loop in a portion of said belt, means for feeding an end of the strip into the loop, means for moving said belt, means for placing said belt under tension to place the strip in compression as it is rolled in the loop, means for discharging the rolled strip from said loop by opening said loop after the strip is rolled up, two substantially horizontally-disposed straight elongate supporting members having portions positioned under an upper portion of said belt and having portions extending to one side of said apparatus for temporarily supporting the upper portion of said belt above said apparatus and to aid in removing said belt to the one side of said apparatus.

16. Apparatus according to claim 15 characterized by a supporting frame member for temporarily supporting an intermediate upper portion of said belt between said elongate supporting members at the one side of said apparatus, and means for movably supporting said frame member in a belt-supporting position between said elongate supporting members and in an out-of-the-way position spaced from said apparatus.

* * * * *